United States Patent [19]

Billing

[11] Patent Number: 4,496,092

[45] Date of Patent: Jan. 29, 1985

[54] ARRANGEMENT IN APPARATUS FOR MECHANICAL NAILING

[76] Inventor: Lars Billing, Värmlangdsgatan 2, S-252 52 Helsingborg, Sweden

[21] Appl. No.: 380,678

[22] PCT Filed: Sep. 1, 1981

[86] PCT No.: PCT/SE81/00244

§ 371 Date: Apr. 30, 1982

§ 102(e) Date: Apr. 30, 1982

[87] PCT Pub. No.: WO82/00792

PCT Pub. Date: Mar. 18, 1982

[30] Foreign Application Priority Data

Sep. 4, 1980 [SE] Sweden ..... 8006182

[51] Int. Cl.[3] ..... B25C 1/00

[52] U.S. Cl. ..... 227/149; 227/147; 227/139

[58] Field of Search ..... 227/147, 149, 139; 411/487, 495; 145/46

[56] References Cited

U.S. PATENT DOCUMENTS

| | | | |
|---|---|---|---|
| 831,303 | 9/1906 | Scott | 411/448 |
| 2,033,361 | 3/1936 | Taylor et al. | 403/157 |
| 2,319,348 | 5/1943 | Richards et al. . | |
| 2,332,653 | 10/1943 | Marcy | 36/19 R |
| 2,376,936 | 5/1945 | Pfeffer | 411/449 |
| 2,502,267 | 3/1950 | McPherson | 411/22 |
| 2,755,453 | 7/1956 | Cloutier | 339/220 R |
| 2,786,202 | 3/1957 | Gaulke | 227/147 |
| 3,143,915 | 8/1964 | Tendler | 411/29 |
| 4,017,142 | 4/1977 | Clark et al. | 399/220 T |

FOREIGN PATENT DOCUMENTS

| | | |
|---|---|---|
| 118728 | 8/1944 | Australia . |
| 166703 | 4/1904 | Fed. Rep. of Germany . |
| 324650 | 9/1920 | Fed. Rep. of Germany . |
| 811638 | 8/1951 | Fed. Rep. of Germany . |
| 2811640 | 9/1978 | Fed. Rep. of Germany . |
| 1278641 | 10/1960 | France . |
| 117712 | 6/1939 | Sweden . |
| 125315 | 6/1949 | Sweden . |
| 409543 | 5/1934 | United Kingdom . |
| 618911 | 3/1949 | United Kingdom . |
| 855640 | 12/1960 | United Kingdom . |
| 1431479 | 4/1976 | United Kingdom . |

*Primary Examiner*—Donald R. Schran
*Assistant Examiner*—James Wolfe
*Attorney, Agent, or Firm*—Fleit, Jacobson, Cohn & Price

[57] ABSTRACT

Device in a mechanical nailing apparatus including a nail holder to support and guide a nail into position for nailing by means of a nail driver. The device is especially designed for nails (51) which, after being nailed, has at least one laterally expanded anchoring portion (52). The inner cavity of the nail holder (55, 56) intended to receive the nail defines, along part of the nail (51), a guide seat (53) of non-circular section adapted to co-operate complementarily with a guide portion (52) on the nail (51) such that the nail, as it is carried into position for nailing, is given a definitely fixed angle of orientation about its longitudinal axis relative to the nail holder. By positioning of the nail holder, i.e. the nailing apparatus, into a suitable angle for anisotropic materials, e.g. the fibre direction in wood, an expansion nail may be nailed in the angular position where the nail will reach maximum gripping power.

2 Claims, 8 Drawing Figures

ARRANGEMENT IN APPARATUS FOR MECHANICAL NAILING

The present invention relates to a means for orienting the turning angle of a nail about its longitudinal axis before driving in the nail by means of an apparatus adapted for mechanical nailing. Such an apparatus includes, on one hand, a nail holder holding the nail in position for nailing and, on the other hand, a nail driver for driving in the nail.

Existing apparatuses for mechanical nailing or nailing by machine completely lack means for turning or orienting the nail into a certain desired angular position about its longitudinal axis and holding the nail in this position prior to nailing. This is a great inconvenience when it is a matter of mechanical nailing with expanding nails, especially such expansion nails which, after nailing, exhibit one or more anchoring portions, i.e. portions of the nail expanded or split out from the shaft of the nail inside the material. Especially when using expansion nails in non-isotropic materials it is a great advantage to orient the nail into such an angle of orientation relative to the structure of the material that maximum gripping power is obtained.

A common such case is the use of expansion nails according to the Swedish Pat. No. 7703167-2 for nailing in wood or joining of wooden details. A portion of this expansion nail, situated adjacent the point thereof, is deformed outwardly towards both sides. It is obvious that such a nail will take a better hold in the wood and thus attain much greater gripping power if the expanding portions extend at right angles to the wood fibre direction than if they would extend in parallel with the fibre direction.

By this invention a positioning or orientation means is provided for orienting a nail into such a position of rotation that the nail gripping power attains a maximum after being driven into anisotropic materials. According to the invention this great advantage is achieved in a most simple, cheap and reliable manner in that the inner, nail-receiving cavity in the nail holder defines, along a portion of the nail, a guide seat of non-circular cross-section adapted to cooperate complementarily with a guide portion of the nail such that the nail will be held in a definitely fixed angle of orientation about its longitudinal axis relative to the nail holder.

In preferred embodiments of the invention the guide seat of the nail holder is adapted to guide portions of the nail comprising a non-circular nail head, a bulged portion of an expansion or rivet nail or a wedge or chisel-shaped point. In the latter case the guide seat is an edge seat in the nail holder.

An advantageous means is realized if the nail holder consists of at least two jaws which are movable outwards from the nail and away from each other and are kept resiliently pressed against each other. By this protruding nail portions such as the nail head and bulges of a rivet nail may be pushed through the entire nail holder by the nail-driver.

The invention will now be described in detail with reference to the accompanying drawing, in which.

Figure 1:
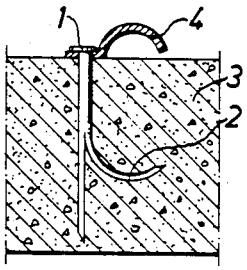
FIGS. 1 and 2 show examples of two prior art types of expansion nails.

FIG. 1 shows an expansion nail 1 with an anchoring portion 2. The nail is driven into the material 3 to fasten a clip 4, for instance for wiring on a wall.

Figure 2:
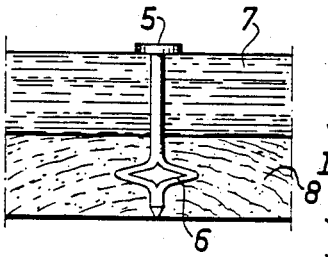

FIG. 2 shows an expansion nail 5 according to the above-mentioned Swedish patent, as used for joining of two wooden parts 7 and 8. The nail includes an expansion portion 6 extending outwards on either side of the nail at right angles to the wood fibre direction.

Figure 3:
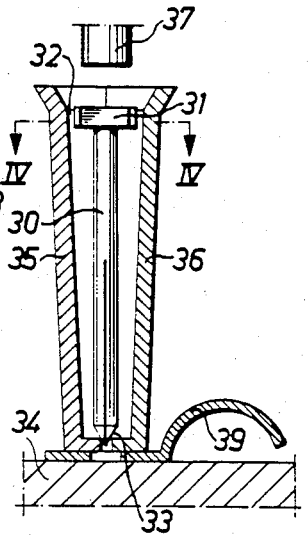
FIG. 3 is a longitudinal section through a nail holder including the nail shown in FIG. 1.

FIG. 3 shows a nail holder in which a nail 30 of the type shown in FIG. 1 lies ready for nailing. The nail head 31 constitutes the guide portion and coacts with a guide seat 32 in the nail holder in a manner to be described in greater detail below. The point of the nail 30 is designated by 33. It abuts against, or lies close to the material 34 into which it is to be driven.

The nail holder consists of two spring-loaded cheeks or jaws 35 and 36 which are movable in outward direction. Above the nail head 31 is a nail driver 37 for driving the nail into the material 34. When the nail driver 37 drives the nail 30 into the material 34 the point 33 of the nail presses aside the jaws 35, 36 and penetrates into the material. After the nail has come into contact with the material it cannot turn about its longitudinal axis but is non-rotatably oriented relative to the material. As the driving-in operation continues the nail head 31 moves downwards while carrying apart the spring-loaded jaws 35 and 36 until the nail comes outside the jaws and is fixed in position. The nail 30 may, for instance, fasten a clip designated by 39.

Figure 4:
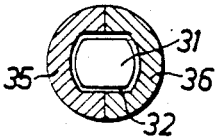
FIG. 4 is a cross-section of the nail holder, taken on line IV—IV in FIG. 3.

FIG. 4 shows a cross-section of the device on line IV—IV in FIG. 3. From the figure appears how the expansion nail 30 has been brought into the desired angular position about its longitudinal axis. The nail head 31 is defined by two straight edges and two circular arcs situated therebetween. The nail head will thus constitute the guide portion of the nail with which the complementary shaped guide seat 32 of the nail holder will coact. The guide seat 32 is placed straight opposite the nail head 31 when the nail is in position for nailing and leaves a certain play for the nail head, i.e. for the guide portion 31 of the nail.

The nail 30 can be carried towards its position for nailing by means of gravity, of a spring, of an air current or the like. During this movement the guide portion—the head 31—of the nail 30 is carried into the guide seat of the nail holder 35, 36, where it is brought into the desired angle of orientation. This introduction into the seat is also facilitated by vibrations or other movements in the nailing apparatus. The nail is then kept in starting position for nailing.

Figure 5:
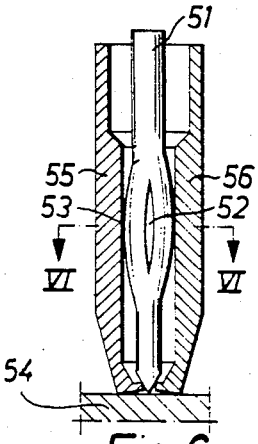
FIG. 5 shows the lower part of another nail holder adapted to a nail according to FIG. 2.

FIG. 5 shows a nail holder adapted for a rivet nail 51 to the expansion portion 52 of which is utilized as guide portion. The jaws of the nail holder, designated by 55 and 56, have an inner guide seat 53 for coaction with the guide portion 52 of the nail 51. The material into which the nail is to be driven is designated by 54. The device shown in FIG. 5 corresponds in principle to the device of FIG. 3.

Figure 6:
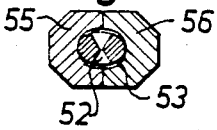
FIG. 6 is a section through nail and nail holder, taken on line VI—VI in FIG. 5.

FIG. 6 shows a cross-section of the parts in FIG. 5 taken on line VI—VI. From the figure appears the substantially ellipse-shaped expansion portion 52 and the corresponding guide seat 53 in the nail holder 55, 56, having a slight interference with the expansion portion 52. As in the device described above with reference to FIGS. 3 and 4, the nail 51 has been brought into a definite, fixed angle of orientation in the nail holder prior to nailing which is carried out by means of a nail driver in the manner described above.

Figure 7:
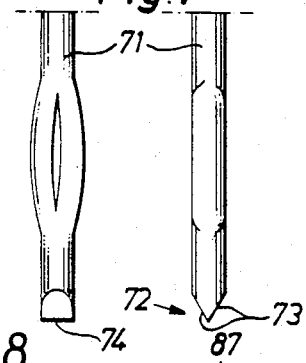
FIG. 7 shows, in two relatively perpendicular directions, a nail according to FIG. 2, with a specifically shaped point.

FIG. 7 shows the point of a rivet nail 71 as viewed in two relatively perpendicular directions. In the case shown the point 72 of the nail 71 is in the form of a wedge or chisel-shaped portion having two surfaces 73, inclined towards one another and an edge 74. The point 72 with the portion 73, 74 constitutes the guide portion of the nail.

Figure 8:
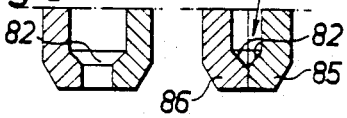
FIG. 8 shows, in two relatively perpendicular directions, corresponding to those shown in FIG. 7, a further nail holder adapted for cooperation with the nail shown in FIG. 7.

FIG. 8 shows in two relatively perpendicular sections the outermost point of a nail holder with jaws 85, 86 and a guide seat 87 which is adapted for coaction with the chisel-shaped point 72, 73, 74 of the nail in FIG. 7. The right-hand part of FIG. 8 shows the resilient jaws 85 and 86 the inner lowermost portions of which consist of two angularly disposed planes 82 which form a seat for the chisel-shaped point 72 of the nail 71. The seat or edge location 87 constitutes the guide seat of the nail holder 85, 86. When the point 72 of the nail rests in the seat 87 the nail 71 is oriented in the desired angle of orientation and is ready for nailing in the manner described above.

It has been described in the foregoing how expansion nails according to the invention have been brought into a defined fixed position relative to the mechanical nailing apparatus. Thus, in order to produce maximum gripping power when driving in nails in anisotropic materials it is easy to turn the apparatus into the desired position relative to the material, e.g. with respect to the fibre direction in wood.

In the above examples a nail holder with two jaws has been described. Of course it is possible to use holders having three or more jaws, to give the guide portion of the nail and the guide seat of the nail holder adapted thereto a triangular or other non-circular configuration or to carry out other modifications within the scope of the appended claims without departing from the inventive idea.

I claim:

1. A nail holder for supporting and guiding a headed nail into position to be driven by a nail driver, the headed nail having a laterally displaced bulged guide portion restricted to a portion of the nail shank adjacent the point of the nail opposite its head, said nail holder comprising:

a main body, a nail-receiving cavity defined in the main body of the nail holder, said nail holder being positioned to abut material to be nailed and said nail holder being adapted for simultaneously holding the nail in the nail-receiving cavity and to orient the nail with respect to the material to be nailed; and said nail receiving cavity including a nail receiving portion and a guide seat portion of oblong cross-section complementary in shape to the cross section of the laterally displaced bulged guide portion of the nail, to hold the nail in a definitely fixed angle of orientation about its longitudinal axis relative to the nail holder and said nail receiving first portion being of different and larger cross section than said guide seat portion to permit the laterally displaced bulged guide portion of the nail to move through said nail receiving first portion and into alignment with said guide seat portion whereby the nail is held in a fixed orientation when driven by a nail driver.

2. A device as claimed in claim 1, wherein the nail holder consists of at least two jaws which are resiliently pressed against each other and movable away from each other in an outward direction.

* * * * *